US005625399A

United States Patent [19]

Wiklof et al.

[11] Patent Number: 5,625,399

[45] Date of Patent: Apr. 29, 1997

[54] METHOD AND APPARATUS FOR CONTROLLING A THERMAL PRINTHEAD

[75] Inventors: Christopher A. Wiklof, Everett; Edward M. Millet, Seattle; Thomas A. Sweet, Everett, all of Wash.

[73] Assignee: Intermec Corporation, Everett, Wash.

[21] Appl. No.: 830,310

[22] Filed: Jan. 31, 1992

[51] Int. Cl.[6] ..... B41J 2/36; B41J 2/365

[52] U.S. Cl. ..... 347/195; 347/211

[58] Field of Search ..... 346/76 PH; 400/120, 400/120.09, 120.14, 120.15; 347/211, 195, 188, 189, 194, 196

[56] References Cited

U.S. PATENT DOCUMENTS

| | | | |
|---|---|---|---|
| 3,975,707 | 8/1976 | Ito et al. | 346/76 PH |
| 4,391,535 | 7/1983 | Palmer . | |
| 4,567,488 | 1/1986 | Moriguchi et al. | 346/76 PH |
| 4,675,695 | 6/1987 | Samuel . | |
| 4,870,428 | 9/1989 | Kuwabara et al. | 346/76 PH |
| 4,937,590 | 6/1990 | Robillard et al. | 346/76 PH |
| 5,506,613 | 4/1996 | Helmbold et al. | 347/188 |

FOREIGN PATENT DOCUMENTS

| | | |
|---|---|---|
| 329369 | 8/1989 | European Pat. Off. . |
| 2228450 | 8/1990 | United Kingdom . |

OTHER PUBLICATIONS

ROHM, "To Achieve High Speed Printing".

ABB HAFO,"IPC Users Manual Preliminary", *Thermal Print Heads*, Nov. 1989.

*Primary Examiner*—Huan H. Tran

*Attorney, Agent, or Firm*—Seed and Berry LLD

[57] ABSTRACT

A method and apparatus for controlling a thermal printhead. In response to a sequence of print commands, the method and apparatus generate an energization signal for each thermal print element in the printhead. In one embodiment, the energization is a function of at least the present print command and a future print command. In certain embodiments, the energization signal may also be a function of a past print command, print commands for at least one adjoining print element, and other parameters. Each print element in the printhead can, accordingly, be maintained at a proper temperature to ensure long printhead life and cause the printhead to generate sharp images.

44 Claims, 12 Drawing Sheets

| PREVIOUS SLT DOT STATE | NEXT SLT DOT STATE | CURRENT SLT PULSE TYPE |
|---|---|---|
| 0 | 0 | a |
| 0 | 1 | b |
| 1 | 0 | c |
| 1 | 1 | d |

WHERE 0 DENOTES PREVIOUS OR NEXT DOT OFF
1 DENOTES PREVIOUS OR NEXT DOT ON
AND PULSE TYPES ARE AS FOLLOWS:

DI, DO, STR: n=4 DOT: a=896 dots

| n | DOT No. | dots/STR |
|---|---|---|
| 1 | 1 – 128 | 128 |
| 2 | 129 – 384 | 256 |
| 3 | 385 – 640 | 256 |
| 4 | 641 – 896 | 256 |

| | | | | | |
|---|---|---|---|---|---|
| 1 | □<br>□<br>□●□ | LEVEL 1 | 9 | ■<br>□<br>□●□ | LEVEL 2 |
| 2 | □<br>□<br>□●■ | LEVEL 1 | 10 | ■<br>□<br>□●■ | LEVEL 3 |
| 3 | □<br>□<br>■●□ | LEVEL 1 | 11 | ■<br>□<br>■●□ | LEVEL 3 |
| 4 | □<br>□<br>■●■ | LEVEL 2 | 12 | ■<br>□<br>■●■ | LEVEL 3 |
| 5 | □<br>■<br>□●□ | LEVEL 4 | 13 | ■<br>■<br>□●□ | LEVEL 4 |
| 6 | □<br>■<br>□●■ | LEVEL 5 | 14 | ■<br>■<br>□●■ | LEVEL 5 |
| 7 | □<br>■<br>■●□ | LEVEL 5 | 15 | ■<br>■<br>■●□ | LEVEL 5 |
| 8 | □<br>■<br>■●■ | LEVEL 6 | 16 | ■<br>■<br>■●■ | LEVEL 6 |

■ —— 2nd previous dot heated
□ —— Previous dot not heated
■●□ — Dot to be controlled
— Right adjacent dot, current SLT not heated
— Left adjacent dot, current SLT heated

FIG. 5
(PRIOR ART)

| | | |
|---|---|---|
| | $P_5$ | |
| | $P_4$ | |
| | $P_3$ | |
| | $P_2$ | |
| | $P_1$ | |
| L | C | |
| | F | FN |

| | | | | | | | | | | |
|---|---|---|---|---|---|---|---|---|---|---|
| L | FN | $S_3$ | $S_4$ | F | C | $P_1$ | $P_2$ | $P_3$ | $P_4$ | $P_5$ |

$S_3S_4$= TWO MOST SIGNIFICANT BITS OF SEGMENT COUNT e.g., $S_3S_4$= 00 INDICATES FIRST 8 SEGMENTS OF SLT $S_3S_4$= 01 INDICATES SECOND 8 SEGMENTS OF SLT

| PREVIOUS SLT DOT STATE | NEXT SLT DOT STATE | CURRENT SLT PULSE TYPE |
|---|---|---|
| 0 | 0 | a |
| 0 | 1 | b |
| 1 | 0 | c |
| 1 | 1 | d |

WHERE 0 DENOTES PREVIOUS OR NEXT DOT OFF
1 DENOTES PREVIOUS OR NEXT DOT ON
AND PULSE TYPES ARE AS FOLLOWS:

METHOD AND APPARATUS FOR CONTROLLING A THERMAL PRINTHEAD

TECHNICAL FIELD

The present invention relates to thermal printers, and more particularly to a method and apparatus for controlling a thermal printer.

BACKGROUND OF THE INVENTION

A thermal printer operates by sequentially heating desired linear patterns of small discrete areas ("pixels") of a thermal medium to produce desired light and dark patterns on the thermal medium. In some instances, the thermal medium can be a thermally sensitive medium which is heated directly, while in other instances, the thermal medium can be a thermal transfer ribbon which is heated to cause a small amount of dyed wax to be transferred to a medium which is not thermally sensitive.

The discrete areas of the thermal medium are heated by a thermal printhead which includes a linear array of minute, closely spaced resistive dots (or print elements) that can be individually thermally controlled by means of electrical signals. The thermal medium is stepped past the printhead as each desired linear pattern is printed. The printhead is positioned over each part of the thermal medium for a predetermined interval of time (the "scan line time," SLT) which depends upon the printer's print speed. For example, for printers, at 2 inches per second each interval of time is approximately 2.5 milliseconds long.

A print command signal for each print element determines, on a time interval basis, whether the print element should print or not within an SLT. In response to the print command signal, each print element in a printhead receives an electrical energization signal that is a composite of two other electrical signals. Specifically, the energization signal is a logical AND of a strobe signal and a data signal. The strobe signal, which is periodically sent to each of the print elements and is tailored to cause the print element to reach and maintain a temperature within a prescribed temperature range under controllable conditions. As will be discussed in greater detail subsequently, the strobe signal typically consists of two portions—an initial "burn" time and a subsequent "chopped" time. If the strobe signal were applied directly to the print element, the burn time portion of the strobe signal would force the print element to heat up quickly. The chopped time portion of the strobe signal typically maintains the print element's temperature and consists of approximately 25 cycles of a square wave with a 50 percent duty cycle. The data signal determines whether, within the period of the strobe signal, any portion of the strobe signal should be applied to a print element to cause it to print.

In the past, it was known to adjust the strobe signal to account for the temperature of the printhead. For example, when a printer first begins operation, its printhead is still at ambient temperature and its individual print elements must be given more energy to cause them to print. Therefore the burn time portion of the strobe signal could be lengthened so that the individual print elements will be heated more and the printhead will reach a normal operating temperature.

After the printhead has reached its operating temperature the strobe signal can be readjusted for these "normal" conditions. Even after the printhead has warmed up, however, departures from the normal conditions can occur. For example, the printhead can experience long periods of time when the printer is producing a label having large white areas, thereby requiring no heating of the individual print elements and allowing the printhead to cool below the normal operating temperature. On the other hand, the printhead may be required to print labels having large black areas, during which the temperature of the printhead will increase above the normal operating temperature. The thermal printer can account for these departures from the normal operating temperature by changing the energization signal through adjustments of the burn time portion of the strobe signal.

It has also been known in the past to adjust the energization of each individual print element depending upon the recent past history of that print element. For example, if a particular print element in a printhead has printed a long row of dark areas, it is known to reduce the "on" time of the energization signal to prevent the print element from producing a dark spot at an improper pixel. Under these circumstances, it is desirable to account for the past history of a particular print element when choosing the print command to be transmitted to the print element. Further, it has also been known in the past that the thermal performance of a particular print element in a printhead is affected by adjacent or nearby print elements in the printhead. Accordingly, it has been known in the past to tailor the energization signal transmitted to a particular print element depending upon the present condition and past history of adjacent print elements in the printhead.

It is desirable to have a printhead whose print elements can be individually programmed depending upon such variables as print speed, media type, ambient temperature, heat sink temperature, user's personal darkness preference, power supply voltage, and printhead average print element resistance. It is also desirable to reduce the thermal stress of each print element in a printhead by modulating the energization signal during the heat-up portion of the strobe but keeping the overall energy dissipation of the print element constant by heating it for a greater portion of the duration of the strobe signal.

It is further desirable to account for the future printing requirements of a particular print element in a printhead, as well as the future printing requirements of adjoining print elements in the printhead when determining the energization signal. For instance, if it is known that a particular print element in the printhead has been off for a period of time but will be used in an upcoming period of time, this print element can be "preheated" during one or more of the immediately preceding print times to raise the print element's temperature.

In addition, it is desirable to adjust the energization signal transmitted to a particular print element in a printhead to affect the placement of a pixel that is printed by that print element within the area of the printer medium over which the print element passes during a particular scan line time.

Also, it is desirable to maintain the temperature of the printhead substrate at an optimal level when the ambient temperature is below optimal printing temperatures.

Further, it is desirable to feed each print element with an energization signal that is a function of a data signal containing two or more sets of data during a scan line time to get adequate resolution for thermal control of the print element.

SUMMARY OF THE INVENTION

According to one aspect, the invention is a method for producing a desired response of a selected first thermal print element within a present interval of time. The desired response is produced in accordance with a sequence of print commands for the first print element. The method comprises the steps of (a) establishing a present print command in a sequence of print commands for the first print element and (b) establishing at least one future print command in the sequence of print commands for the first print element. The method further comprises the steps of (c) specifying a first print element control data stream for the present interval of time as a function of the present and the at least one future print commands for the first print element and (d) generating an energization signal for the first print element as a function of the data stream to produce the desired response of the first print element during the present interval of time. The method also comprises the step of (e) applying the energization signal to the first print element.

In another aspect, the invention is an apparatus for producing a desired response of a selected first thermal print element within a present interval of time. The desired response is produced in accordance with a sequence of print commands for the first print element. The apparatus comprises means for establishing a present print command in a sequence of print commands for the first print element and means for establishing at least one future print command in the sequence of print commands for the first print element. The apparatus also comprises means for specifying a first print element control data stream for the present interval of time as a function of the present and the at least one future print commands for the first print element and means for generating an energization signal for the first print element as a function of the data stream to produce the desired response of the first print element during the present interval of time. The apparatus further comprises means for applying the energization signal to the first print element.

BRIEF DESCRIPTION OF THE DRAWINGS

FIG. 5 is a schematic diagram of thermal printhead patterns known in the prior art.

DETAILED DESCRIPTION OF THE INVENTION

Figure 1:
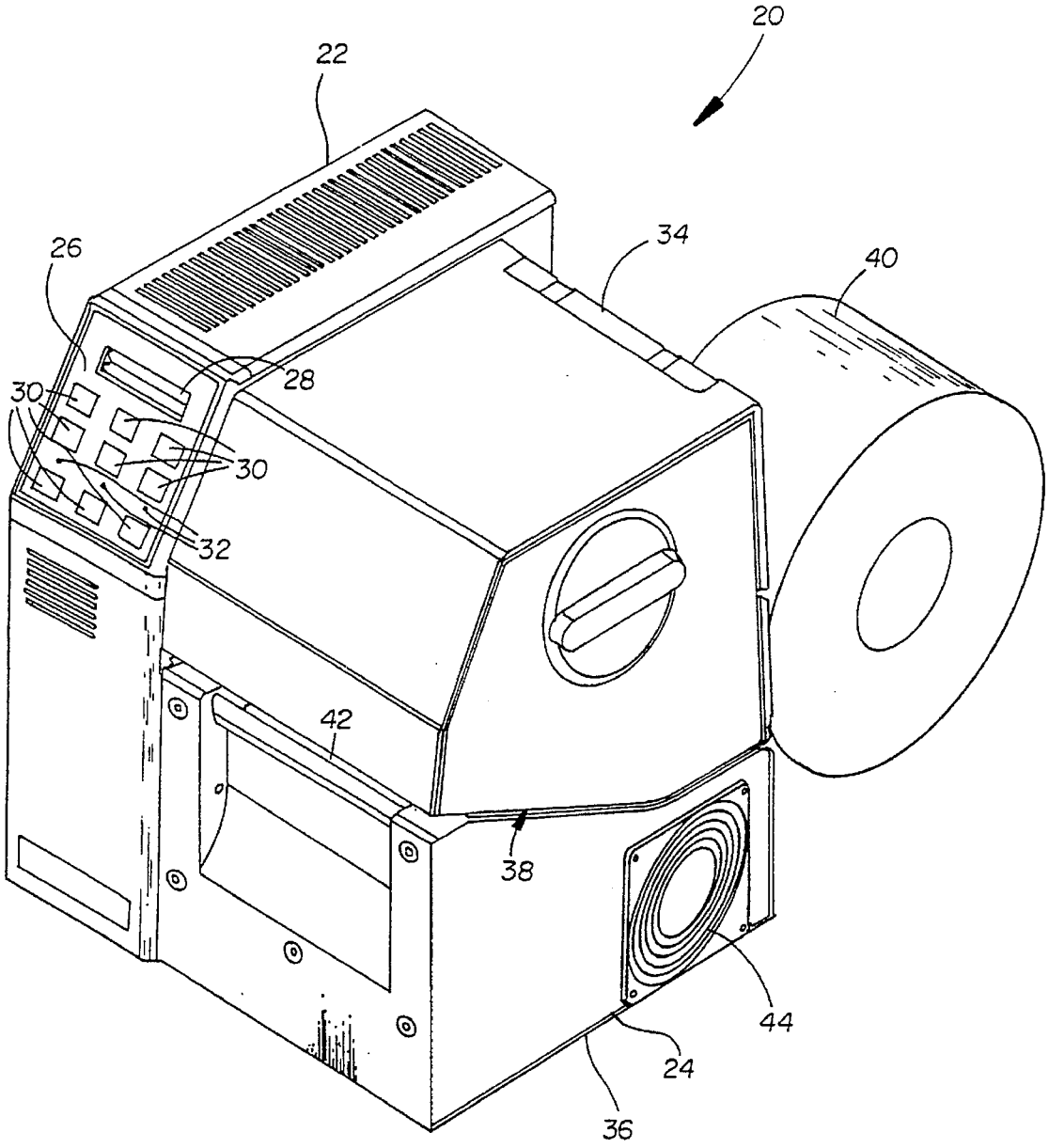
FIG. 1 is a perspective view of a thermal printer.

FIG. 1 is a perspective view of a thermal printer. The thermal printer 20 includes a first housing 22 and a second housing 24. The first housing 22 encloses electrical components, such as electrical motors used in the operation of the thermal printer 20. The first housing 22 also includes a control panel 26 which allows the thermal printer 20 to be controlled and adjusted by a user.

The control panel 26 includes a liquid crystal display (LCD) 28, a plurality of buttons 30, and a plurality of light emitting diodes (LEDs) 32. The LCD 28 provides an alphanumeric display of various commands useful for the user to control and adjust the thermal printer 20. The buttons 30 implement the user's choices of controls and adjustments, and the LEDs 32 provide displays of the status of the thermal printer 20. For example, one of the buttons 30 can be used to toggle the thermal printer 20 on- and off-line, with one of the LEDs 32 indicating when the printer is on-line. Another one of the buttons 30 can be used to select an array of menus that can be displayed in the LCD 28. These means can include choices of print speeds and media types, among other choices. Still another one of the buttons 30 can be used to reload or advance the print medium through the thermal printer 20. Yet another button 30 can be used to open the printer in order to change the print medium.

The second housing 24 includes a printer module 34 and a motor drive module 36 which are normally latched together. The printer module 34 and the motor drive module 36 are separated by a print medium path 38. By activating another one of the buttons 30, the printer module 34 can be caused to unlatch from the motor drive module 36 and rotate backwards, in a clockwise direction as seen in the view of FIG. 1. This action opens the print medium path 38 and allows the adjustment and replacement of the print medium which is introduced into the print medium path 38 from the print medium roll 40. The print medium supplied on the print medium roll 40 is available in a variety of thicknesses, thermal sensitivities, and materials, depending upon the use to be made of the print medium. The print medium supplied from the print medium roll 40 passes through the print medium path 38 and exits through the opening 42. If the print medium is a thermal transfer medium, a thermal transfer ribbon is placed in a separate drive mechanism contained within the printer module 34. This separate drive mechanism provides supply and take-up rolls for the thermal transfer ribbon, the rolls being separately controllable from the movement of the print medium. This permits saving the thermal transfer ribbon when the pattern to be printed on the print medium contains areas where no printing is required. The motor drive module 36 also contains a cooling fan (not shown) which exhausts air through the grill 44.

Figure 2:
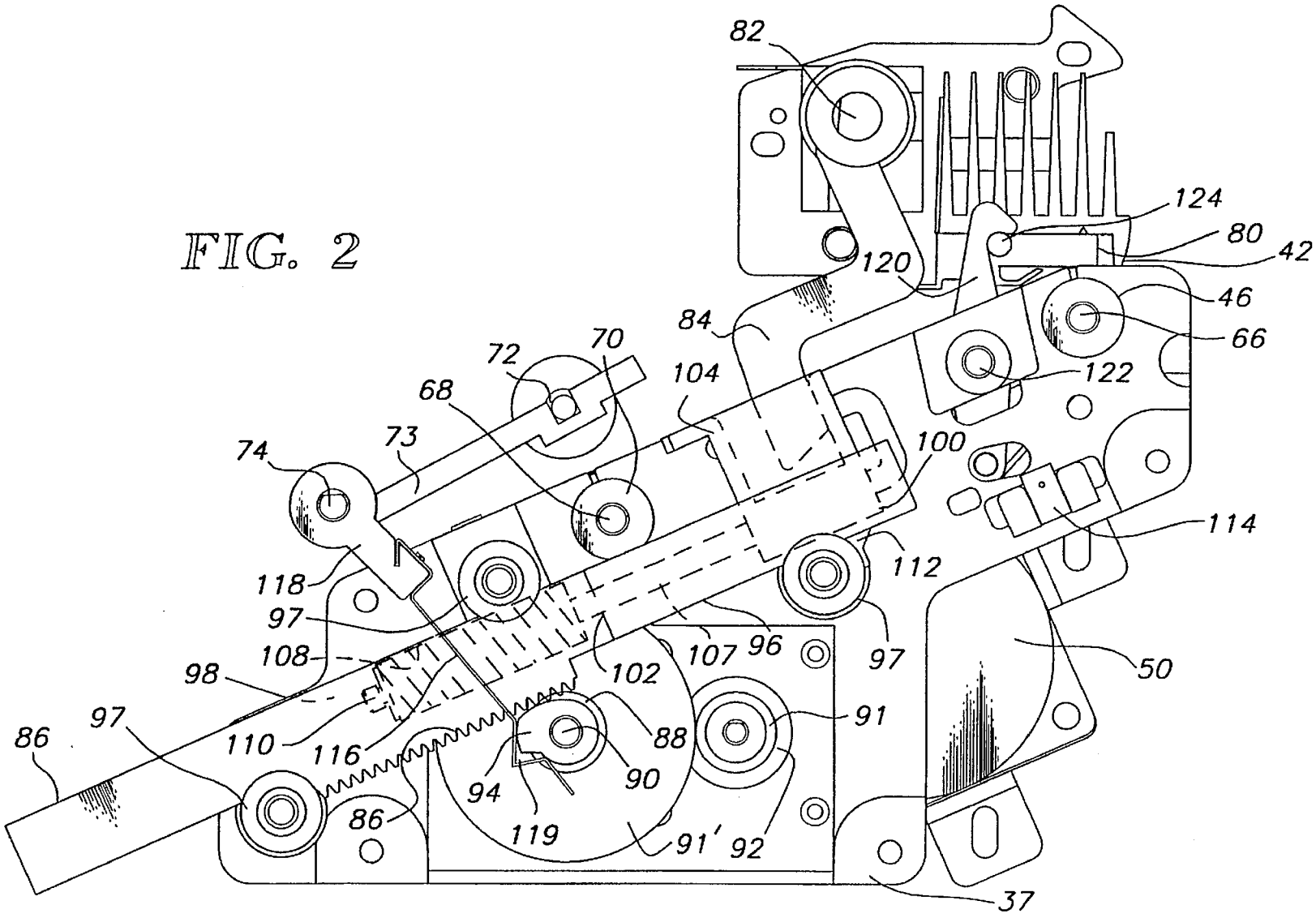
FIG. 2 is an elevational view of a print medium drive mechanism of the thermal printer of FIG. 1.

FIG. 2 is an elevational view of an adjustable printhead pressure mechanism contained within the second housing 24. The printhead pressure mechanism is in a "print" mode.

The printhead pressure mechanism includes a platen roller 46 placed near the position of the opening 42, shown in FIG. 1. The print medium from the print medium roll 40 passes through the print medium path 38 with its printed side facing up. The print medium is advanced through the print medium path 38 by an advancement mechanism and forced to pass between the platen roller 46 and a thermal printhead 80 which is located near the opening 42 (also shown in FIG. 1).

When the printer module 34 is locked in position against the motor drive module 36, the print medium is forced against the printhead 80 by the platen roller 46. In order to accommodate a wide variety of printer media, the pressure between the platen roller 46 and the printhead 80 is variably adjustable.

The printhead 80 rotates about the shaft 82, to one end of which is affixed the arm 84. Accordingly, clockwise movements of the arm 84 about the shaft 82 cause the printhead 80 to move toward the platen roller 46. If the printhead 80 is moved so that it is engaged against a print medium passing between the platen roller 46 and the printhead 80, further clockwise movements of the arm 84 about the shaft 82 will cause the pressure of the printhead 80 against the print medium to increase.

Movements of the arm 84 are controlled by the rack and pinion mechanism including the rack 86 and the pinion gear 88. The pinion gear 88 is attached to the shaft 90, which is driven by the stepper motor 92. A cam 94 is attached to the end of the shaft 90.

The rack 86 is formed on a carrier 96 which includes a first cavity 98 and a second cavity 100. The first cavity 98 and the second cavity 100 are separated by a wall 102. A container 104, adapted to receive the end of the arm 84, is placed in the second cavity 100, adjacent to the wall 102. A wire form 106, impinging on the right-hand wall of the container 104 and then passing to the left through a lower portion of the container 104, through a hole in the wall 102, into the first cavity 98, exerts a leftward force against the arm 84 through the action of the spring 108 on the portion of the wire form 106 in the first cavity 98 between the wall 102 and the end 110 of the wire form 106. If the stepper motor 92 is activated to cause the pinion gear 88 to rotate in a counterclockwise direction, the carrier 96 receives a leftward force through the action of the wall 102 against the wire form 106 by virtue of the spring 108 placed around the wire form 106 and the first cavity 98. This leftward force causes the wire form 106 to bear with increasing force in a leftward direction against the container 104 in the second cavity 100. This, in turn, increases the leftward force against the arm 84, creating a clockwise torque on the shaft 82. This torque increases the pressure of the printhead 80 on the print medium passing between the printhead 80 and the platen roller 46. Continuing counterclockwise operation of the stepper motor 92 further compresses the spring 108, thereby variably increasing the pressure of the printhead 80 against any print medium between the printhead 80 and the platen roller 46.

Also attached to the bottom of the carrier 96 is a projection 112 which passes between the two opposing faces of an optical caliper detector 114, which is held fixed with respect to the motor drive module frame 37. If the stepper motor 92 causes the carrier 96 to slue to the right, the projection 112 will pass between the two halves of the optical caliper detector 114, breaking a light beam which passes from one half of the optical caliper detector 114 to the other half of the optical caliper detector 114. Breaking the light beam causes the optical caliper detector 114 to produce an electrical signal indicating that the carrier has reached a "home" position in which the printhead 80 is moved away from the platen roller 46 by a predetermined repeatable distance. As the carrier 96 moves to the left from the home position, the number of pulses provided to the stepper motor increases from 0, the count at the home position. Therefore, it is possible to apply a highly repeatable pressure of the printhead 80 against the print medium passing over the platen roller 46.

The cam 94 on the end of the shaft 90 engages one end of a leaf spring 116. The other end of the leaf spring 116 is attached to a pivot arm 118, which, in turn, is fixed to the end of the pivot shaft 74. Accordingly, as the cam 94 actuates the leaf spring 116, pivot shaft 76 rotates in a clockwise direction, causing the idler roller 72 to be forced toward the pinch roller 70, capturing the print medium passing therebetween.

In FIG. 2, the carrier 96 of the rack and pinion printhead pressure mechanism has been moved to the left of the home position by a counterclockwise rotation of the stepper motor 92, which causes the cam 94 to enter the detent in the leaf spring 116 and moves an idler roller 72 away from the pinch roller 70. In the print mode, the print medium is advanced through the print medium path 38 by the force of the platen roller 46 against the print medium due to the pressure applied against the print medium by the printhead 80.

Figure 3:
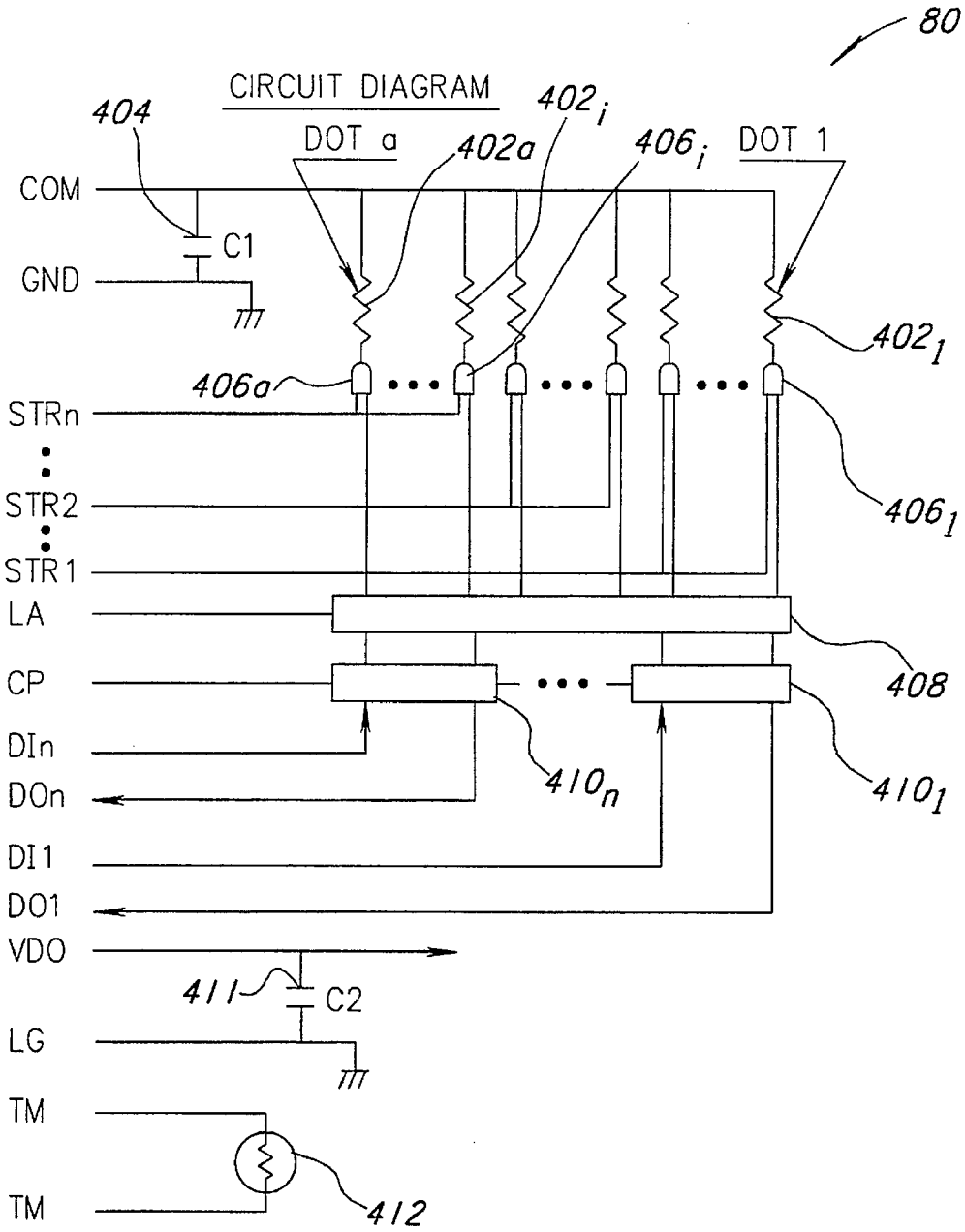
FIG. 3 is an electrical schematic of a printhead in a thermal printer.

FIG. 3 is an electrical schematic of a printhead in a thermal printer. The printhead 80 comprises a linear array of small, closely spaced resistive print elements $\mathbf{102}_1$–$\mathbf{102}_a$. One end of each of the resistive print elements $\mathbf{102}_i$ is connected to an electrical common line which is maintained at a voltage above ground by a capacitor 104. Preferably, capacitor 104 is a 10 mF, 50 volt capacitor. The other end of each of the resistive print elements $\mathbf{102}_i$ is connected to an AND gate $\mathbf{106}_i$. Each of the AND gates $\mathbf{106}_i$ receives two signals. One of the signals is a strobe signal and the other is a data signal transferred from a latch 108.

In one particular preferred embodiment, the resistive print elements $\mathbf{102}_i$ can be grouped into a number of adjacent groups of print elements, each group occupying a particular region of the thermal printhead 80. This allows each group of print elements to receive an independently generated strobe signal, which can differ from the strobe signals transmitted to the other groups of print elements. For example, if the printhead 80 includes 896 print elements, it can be divided into four independently-drive regions, the first region including 128 print elements and the remaining three regions each including 256 print elements. However, in another preferred embodiment, the same strobe signal is transmitted to each AND gate $\mathbf{106}_i$. The signals representing the data contained in the latch 108 are imposed on one leg of each corresponding AND gate $\mathbf{106}_i$, beginning at a time specified by the latch (LA) signal. This arrangement permits each of the AND gates $\mathbf{106}_i$ to receive its corresponding data at the same time as all of the other AND gates $\mathbf{106}_i$.

The data stored in the latch 108 are transferred from a number of shift registers $\mathbf{110}_1$–$\mathbf{110}_n$. The number of shift registers $\mathbf{110}_i$ corresponds to the groups of print elements discussed previously. Therefore, in the first preferred embodiment discussed above, n=4. Each of the shift registers $\mathbf{110}_i$ receives data from a separate input data line (DIi). The data are shifted into the consecutive stages of the shift register $\mathbf{110}_1$ at times governed by the clock pulse (CP) signal. If desired, the data in each shift register $\mathbf{110}_i$ can be cycled out on the data out line (DOi). The voltage on the logic elements of the printhead 80 (i.e., the latch 108 and the shift registers $\mathbf{110}_i$) is maintained by the capacitor 111. The printhead 80 also includes a thermistor 112 which produces a signal indicative of the temperature of the printhead 80.

Figure 4:
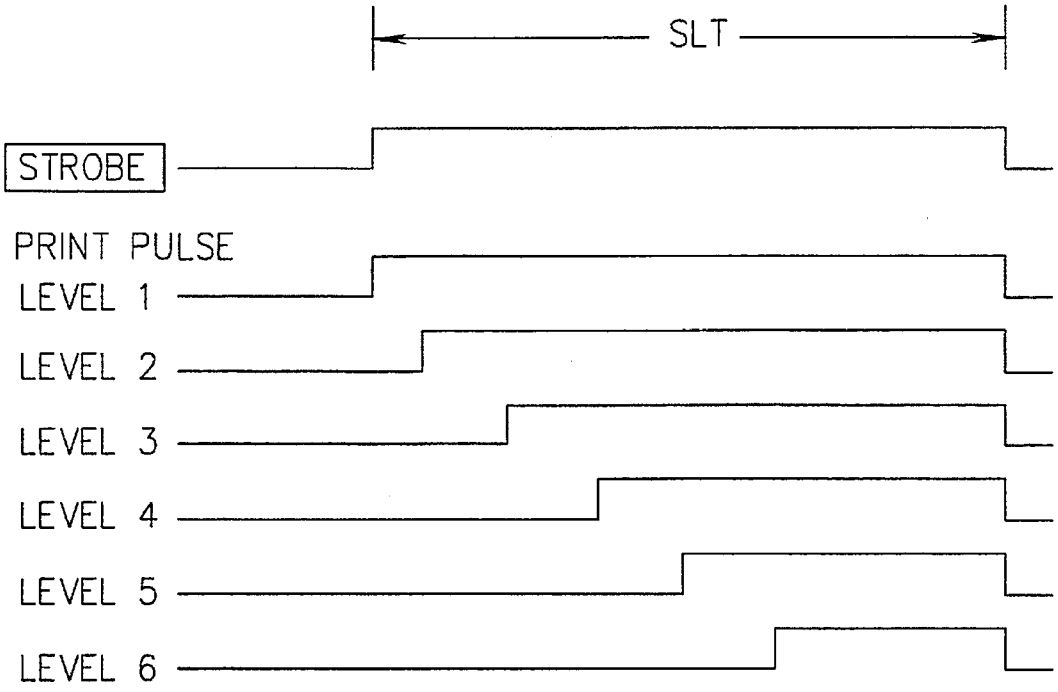
FIG. 4 (PRIOR ART)
FIG. 4 is a timing chart of electrical signals for thermal printheads known in the prior art.

FIG. 4 is a timing chart of electrical signals for thermal printheads known in the prior art. The strobe signal is on for the entire duration of the SLT, while in increasing levels the print pulse signals have shorter and shorter durations, and always terminate at the same time as the strobe signal. As can be seen, increasing the level of a print pulse signal causes the print element to begin printing later in the SLT.

FIG. 5 is a schematic diagram of thermal printhead patterns known in the prior art. The method described by FIG. 5 is based on controlling each print element based on the past history of that print element and the planned present history of adjoining print elements. In this scheme known in the prior art, the present and past status of a given print element and the adjoining print elements is indicated by an array of squares containing symbols that indicate whether the print elements should print. The central square contains a circular dot, indicating that this square represents the current state of the present print element. Ranging above this square are additional squares, successively indicating the past history of the present print element. Adjoining the square indicating the present status of the present print element are squares representing the current status of the adjoining print elements. In the particular example shown in FIG. 5, the control method is concerned only with the current status of the present print element and the present print element's two most recent preceding statuses, as well as the current status of each of the adjoining print elements. Since each of the four squares surrounding the square representing the current print element can have only one of two statuses ("on" or "off"), there are $2^4=16$ possible ways to fill in this array of squares. These 16 possible patterns are divided into 6 groups, each group representing a distinct level of energization for the present print element. While this scheme can be generalized by accounting for the past history of the adjacent print elements, it does not disclose using the forecast future of the current or adjacent print elements in determining the energization of the current print element.

Figure 6A:
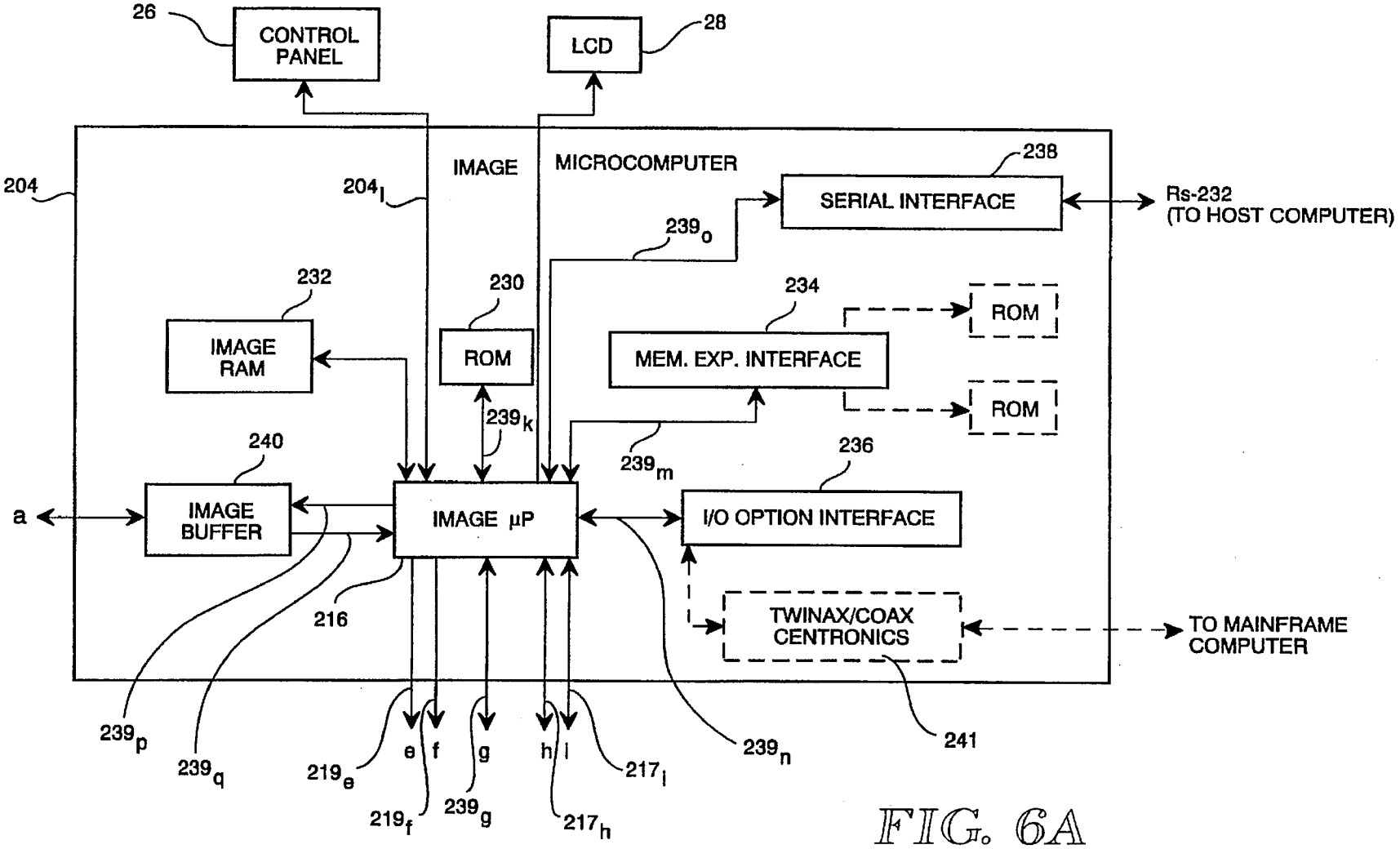
FIG. 6A is a first portion of an electrical schematic diagram of a thermal printer according to the preferred embodiment.
Figure 6B:
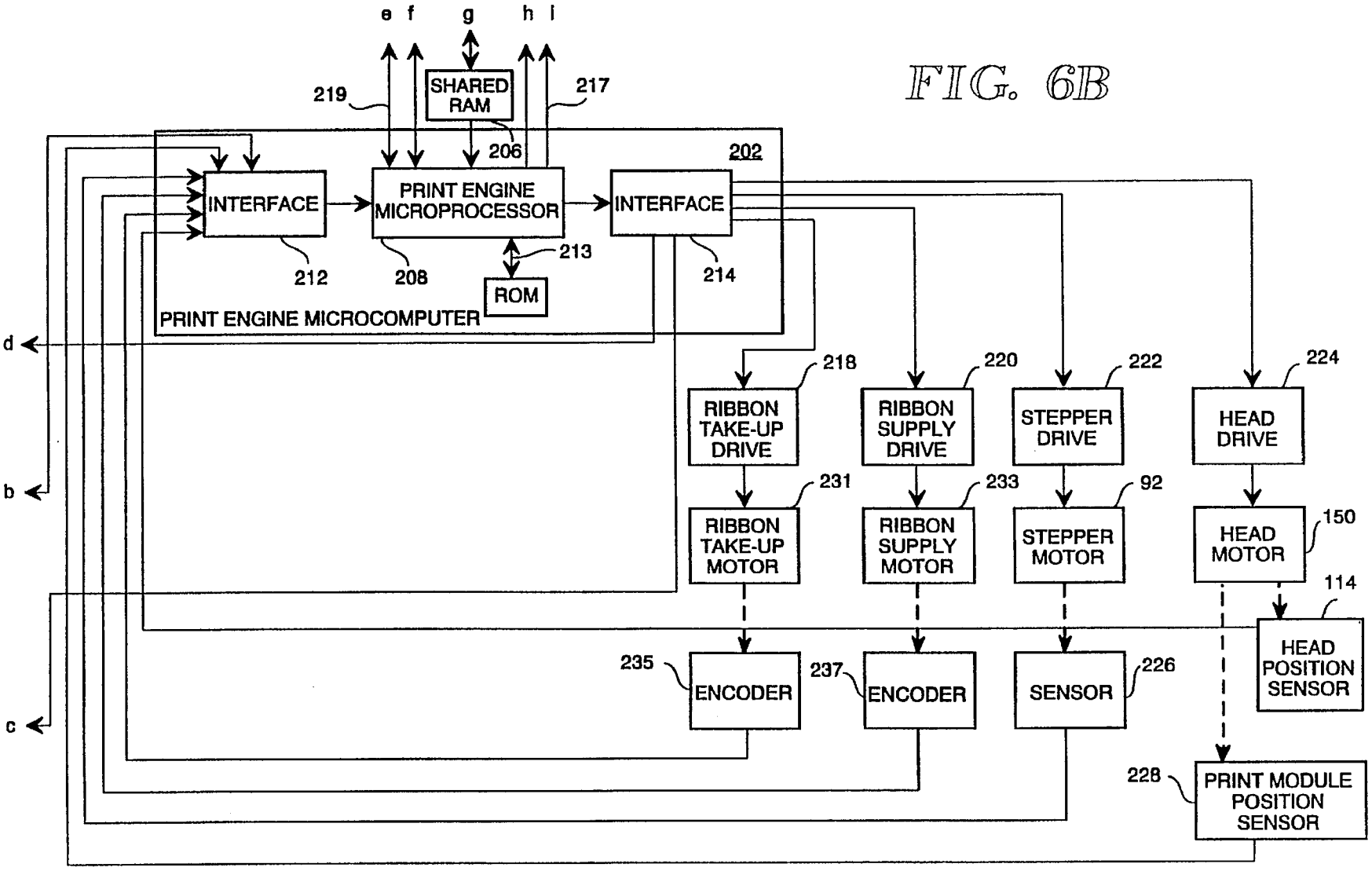
FIG. 6B is a second portion of an electrical schematic diagram of a thermal printer according to the preferred embodiment.
Figure 6C:
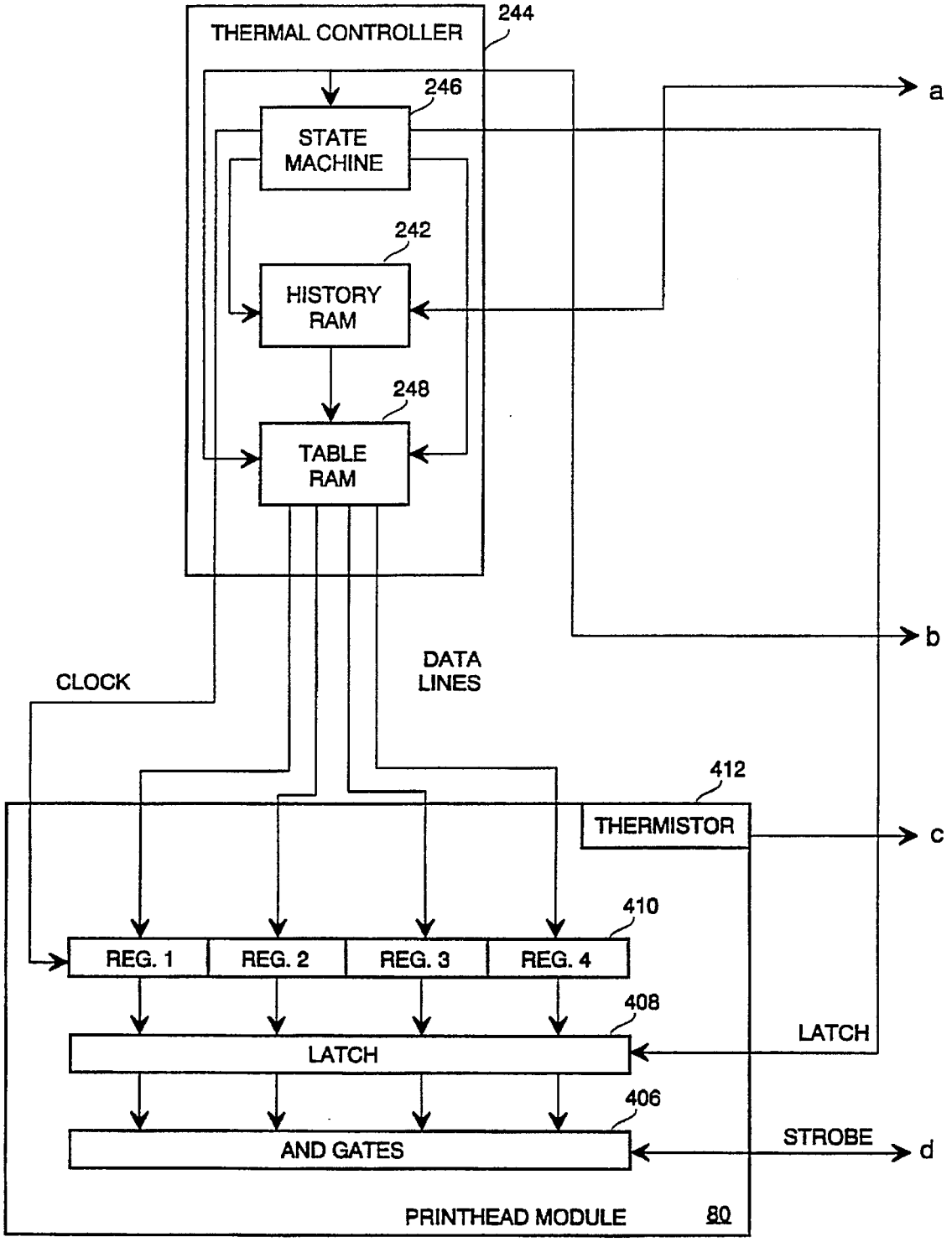
FIG. 6C is a third portion of an electrical schematic diagram of a thermal printer according to the preferred embodiment.

FIG. 6 is an electronics schematic diagram. The electronics includes two microcomputers, a print engine microcomputer 202 and an image microcomputer 204. The print engine microcomputer 202 is primarily responsible for controlling the movement of the print medium and the thermal transfer ribbon (if any) through the printer path and supplying print timing commands to the printhead 80. The image microcomputer 204 produces the images which are to be printed on the print medium. The print engine microcomputer 202 includes a print engine microprocessor 208, a read-only memory (ROM) 210, an input interface 212, and an output interface 214. The ROM 210 communicates with the print engine microprocessor 208 over bidirectional lines. The input interface 212 transmits signals to the print engine microprocessor 208 and the print engine microprocessor 208 transmits signals to the output interface 214.

The image microcomputer 204 includes an image microprocessor 216. The print engine microprocessor 208 and the image microprocessor 216 both communicate over bidirectional lines with a shared random access memory 206. In addition, the print engine microprocessor 208 can communicate interrupt signals to the image microprocessor 216 and the image microprocessor 216 can communicate interrupt signals to the print engine microprocessor 208.

Through the output interface 214, the print engine microprocessor 208 sends the signals to a ribbon take-up drive 218, a ribbon supply drive 220, a stepper motor drive 222, and a head motor drive 224. The stepper motor drive 222 produces appropriate drive signals and transmits them to the stepper motor 50. The head motor drive 224 also produces appropriate signals and sends them to the head motor 150. Movements of the print medium caused by the stepper motor 50 are sensed by the sensor 226 which produces signals that are transmitted to the input interface 212. Movements of the printhead 80 by the head motor 150 are monitored by two sensors, the optical caliper detector 114 and a print module position sensor 228. The optical caliper detector 114 transmits signals to the input interface 212, indicating whether the printhead 80 is in the print mode or the idle mode. The print module position sensor 228 transmits a signal which indicates whether the printer module 34 is disengaged from the motor drive module 36.

The ribbon take-up and ribbon supply drives operate similarly to one another. Each of them receives signals from the output interface 214 and produce signals which drive the ribbon take-up and supply motors, respectively. Under command from the print engine microprocessor they facilitate movements of the thermal transfer ribbon in the print module 34, if a thermal transfer medium is being used. The two ribbon motors are monitored by encoders which send signals to the input interface 212. These signals can be used by the print engine microprocessor 208 in case of a ribbon jam or break. The ribbon take-up and supply drives also operate to balance the torques in their two respective rolls, so that the ribbon moves smoothly, at the same speed as the print medium, without wrinkling or breaking. In addition, in case the print engine microprocessor 208 declares a print save mode, the two ribbon drives bring the ribbon to a halt, which is signified to the print engine microprocessor 208 by the respective encoders.

The image microprocessor 216 also shares information with the ROM 230 and an image RAM 232 on a bidirectional line. The ROM 230 contains programs and used by the image microprocessor 216 and data describing invariant signals, such as the selection of strobe signals which may be used by the print engine microprocessor in a method to be described subsequently. The image RAM 232 contains a number of bands of the image to be printed. In addition, the image microprocessor 216 drives the LCD 28 and communicates with the control panel 26 over a bidirectional line. Further, the image microprocessor 216 communicates over a bidirectional line with the memory expansion interface 234, which has provisions for adding more RAM and ROM to the image microcomputer I/O 204. The image microprocessor 216 also communicates with the I/O option interface 236 over a bidirectional line. The interface 236 allows communications between the image microprocessor 216 and a mainframe computer. This data link can be used to load data to a mainframe computer for further processing, or to load data from a mainframe computer to the image microprocessor 216, such as data for the image RAM 232. Beyond these communication links, the image microprocessor 216 can also communicate with a serial interface 238 over a bidirectional line. This link will also allow the transfer of data in and out of the image microprocessor 216, but will also allow the image microprocessor 216 to be reprogrammed. Finally, the image microprocessor 216 also communicates with an image buffer 240 over a unidirectional bus and receives an interrupt signal from the image buffer 240 over a unidirectional line. The image buffer transfers images the image microprocessor 216 has retrieved from the image RAM 232 to a history RAM 242 in a thermal controller 244. The thermal controller, which produces the signals used to define the thermal images to be printed by the printhead 80, also includes a state machine 246 and a table RAM 248. The state machine 246 produces timing signals needed by the thermal controller 244, under the influence of signals produced by the output interface 214, which is connected to the print engine microprocessor 208. The table RAM 248 is loaded with a table from the ROM 210 in the print engine microcomputer 202 by the print engine microprocessor 208 through the output interface 214. The table RAM 248 receives timing signals from the state machine 246 and the history RAM 242. These signals point to a particular entry in the table RAM 248, depending upon the history of the current print element as designated by the image sent by the image buffer 240 to history RAM 242. The data produced from the table RAM 248 are sent over data lines to the data registers $\mathbf{110}_i$ in the printhead 80. The thermal controller also produces the clock signal which provides proper timing to the registers $\mathbf{110}_i$. The latch and strobe signals are respectively sent to the latch 108 and drivers $\mathbf{106}_i$ by the output interface 214, which receives its input from the print engine microprocessor 208, as described previously. The latch signal is produced by the state machine 246.

Figure 7:
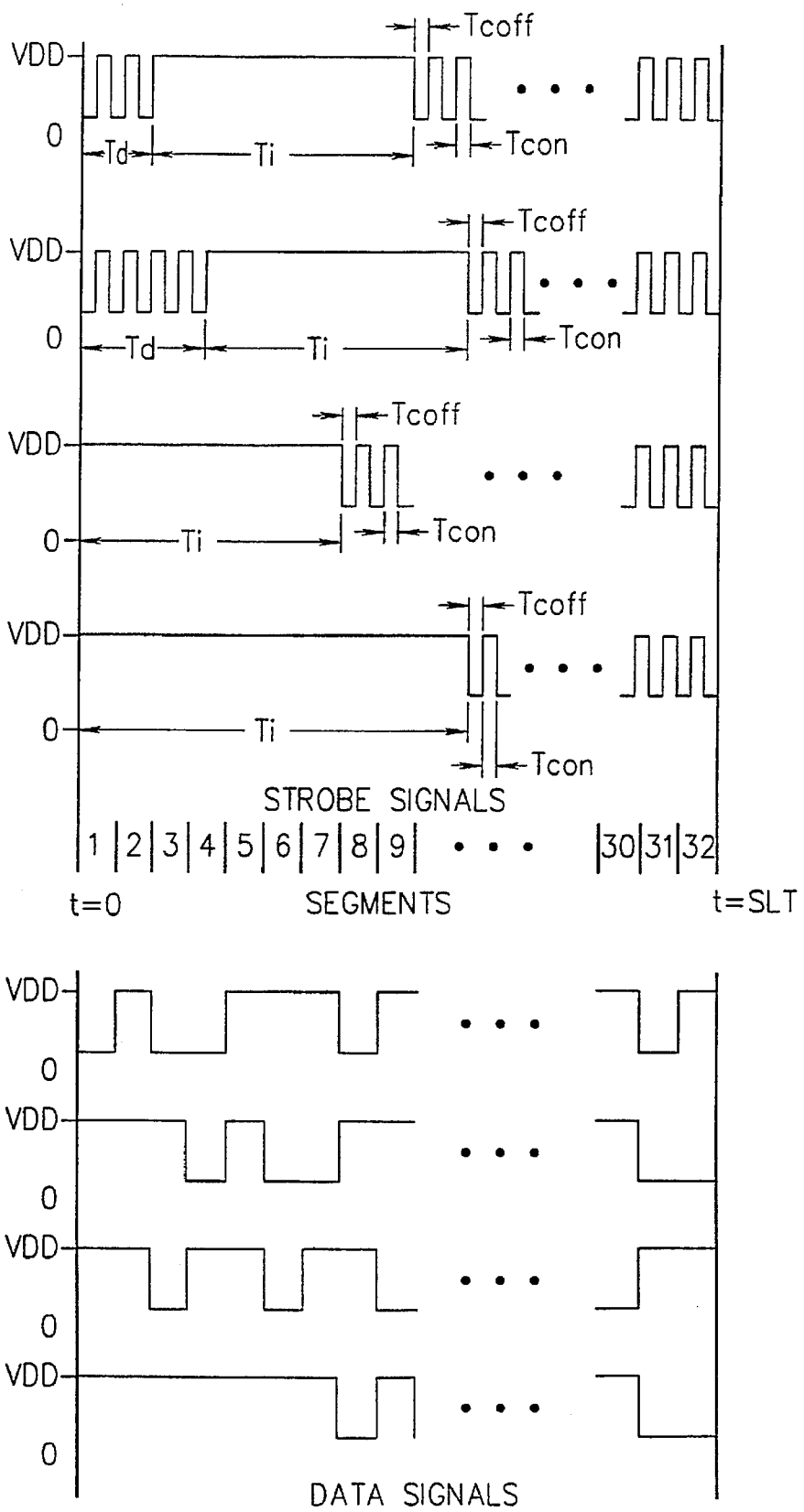
FIG. 7 is a timing chart of electrical signals used in the invention.

FIG. 7 is a timing chart of our electrical signals. As shown, there are a plurality of strobe signals available to the drivers $\mathbf{106}_i$. The strobe signals are composed of four parameterized segments. They are stored in the shared RAM 206 and transferred to the print engine microprocessor 208 when needed. The segments of the strobe signal are an initial chopped segment, followed by an "on-time" segment and a final chopped segment. The initial chopped segment has a fixed duty cycle and a time duration $T_d$. The "on-time" segment has a time duration $T_i$. The final chopped segment has a time duration equal to the remainder of the SLT, its off portions each have a duration of $T_{coff}$ and its on portions have a duration of $T_{con}$. Thus, the plurality of strobe signals can be chosen according to the values of the parameters $T_d$, $T_i$, $T_{coff}$ and $T_{con}$. The choice of strobe signal is determined by the print engine microprocessor 208, based on signals it receives from the image microprocessor 216. The data signals are produced by the table RAM 248 and modulate the chosen strobe signal by placing data in the data lines directed to the registers $\mathbf{110}_i$. At the time of each segment of the SLT for the present strobe, the data from that segment for each of the print element in the particular region of the printhead 80 is loaded into the appropriate register $\mathbf{110}_i$ and used to drive the appropriate print elements.

Figure 8:
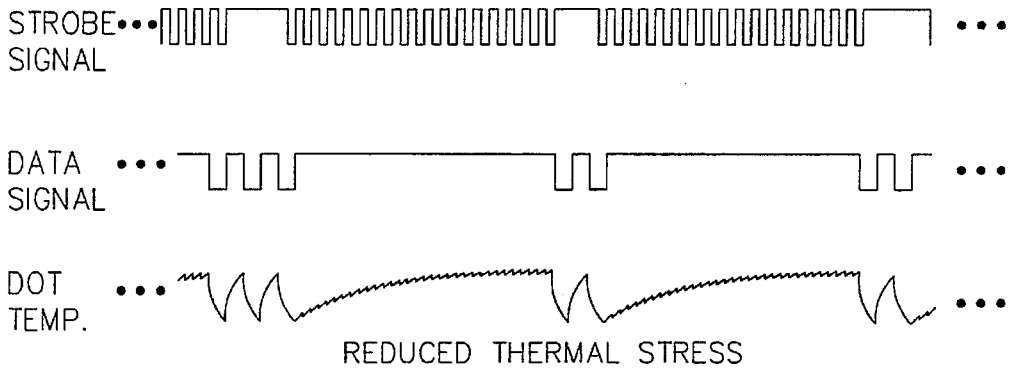
FIG. 8 is a schematic diagram of data structures allowing the adjustment of the strobe signal to reduce thermal stress in the printhead.

FIG. 8 is a schematic diagram indicating the adjustment of the strobe parameters, reduced thermal stress, and cold start. By appropriate choice of the data and possibly the strobe signal, it is possible to reduce the peak print element temperature by modulating the heat-up portion of the strobe signal, while keeping overall energy dissipation constant by heating for a greater portion of each scan line time.

Figure 9:
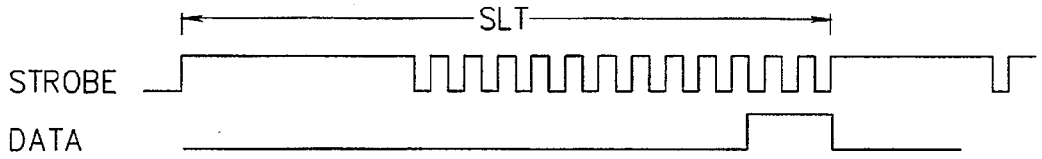
FIG. 9 is a schematic diagram of a method for maintaining the substrate of the printhead at an optimal temperature.

FIG. 9 is a schematic diagram of a method for maintaining the substrate of the printhead 80 at an optimal temperature. In this case, based on the history of a particular print element, as well as its neighboring activity and/or future activity, short energy pulses of a value insufficient to cause darkening of the thermal medium but sufficient to cause a warming effect in the thermal print substrate are applied. In the preferred embodiment, short segments of the SLT corresponding to the chopped portion of the print head strobe are used. This approach keeps the pulse energy sufficiently below that which would cause printing on the medium. The energy of this heat-up pulse can be varied by changing the length of time the chopped strobe is applied to the printhead 80, or by varying the chop duty cycle, based on ambient and/or printhead temperature. Furthermore, cold start pulse activity can be linked to indicators of impending print activity, such as paper motion, data communications activity or internal clock or timing events.

Figures 10A, 10B:
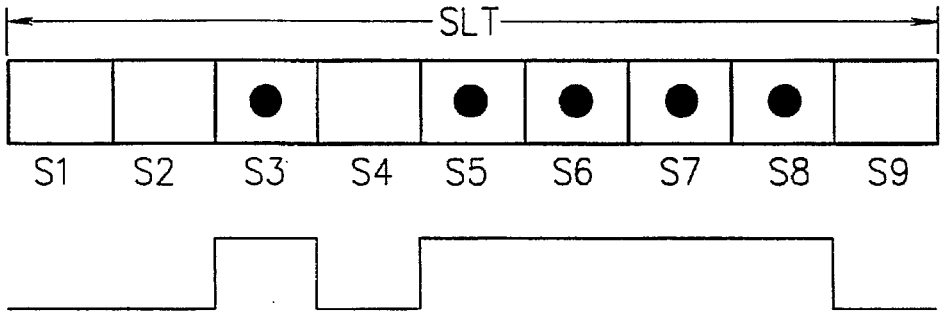
FIG. 10 is a schematic diagram of the future print element look-ahead feature of the present invention.

FIG. 10 is a schematic diagram of the future print element look-ahead feature of the present invention. As described above, the data from the past history, current status and future of the current print element and its surrounding print element can be used to designate an address for use in accessing the history RAM 242 and the table RAM 248.

FIG. 10 is a schematic diagram of a method of the present invention. As shown, the method of the present invention accounts for the future desired response of each particular print element as well as the future desired response of print elements adjacent to the present print element. In the scheme shown in FIG. 10, the present energization of the current print element is considered as well as the past five energizations of the present print element. In addition, the next future response of the present print element is considered. Further, the present energization of the last print element is considered as well as the future energization of the next print element.

FIG. 10 is a schematic representation of the method of the present invention in use to provide programmable rules. In this case, the response applied to a particular print element is a function not only of the past and future activity of the present and adjoining print elements, but also a function of such parameters as print speed, media type, ambient temperature, heat sink temperature, personal darkness preference, power supply voltage, and printhead average print element resistance. Each of these parameters can be determined from the printer itself. The print speed is specified to the thermal printer by the user through the keypad, as is the media type and the individual user's personal darkness preference. The thermistor provides the printer with information concerning the ambient temperature and the heat sink temperature. The printer can also monitor the supply voltage being supplied to the printhead 80. Also, the printer can analyze the printhead 80 to determine the average print element resistance. It is also possible to program the tables externally by user customization of the tables which are then downloaded via a modem or other convenient data communications medium. These data can be used to adjust the strobe profile.

The desired response of a particular print element is specified by a group of binary number, four numbers for each group of segments within an SLT. These binary numbers consist of eleven bits. These eleven bits are L (the current state of the last print element), FN (the future state of the next print element), S4 and S3, which designate which of the four binary numbers is being specified, F (the future state of the current print element), C (the present state of the particular print element), and P1–P5 (the past five states of the current print element). These binary numbers are treated as an address which is used to access the history RAM 242 and return data representing the energization schedule for the segment of the SLT designated by the S4-S3 bits.

Figure 11:
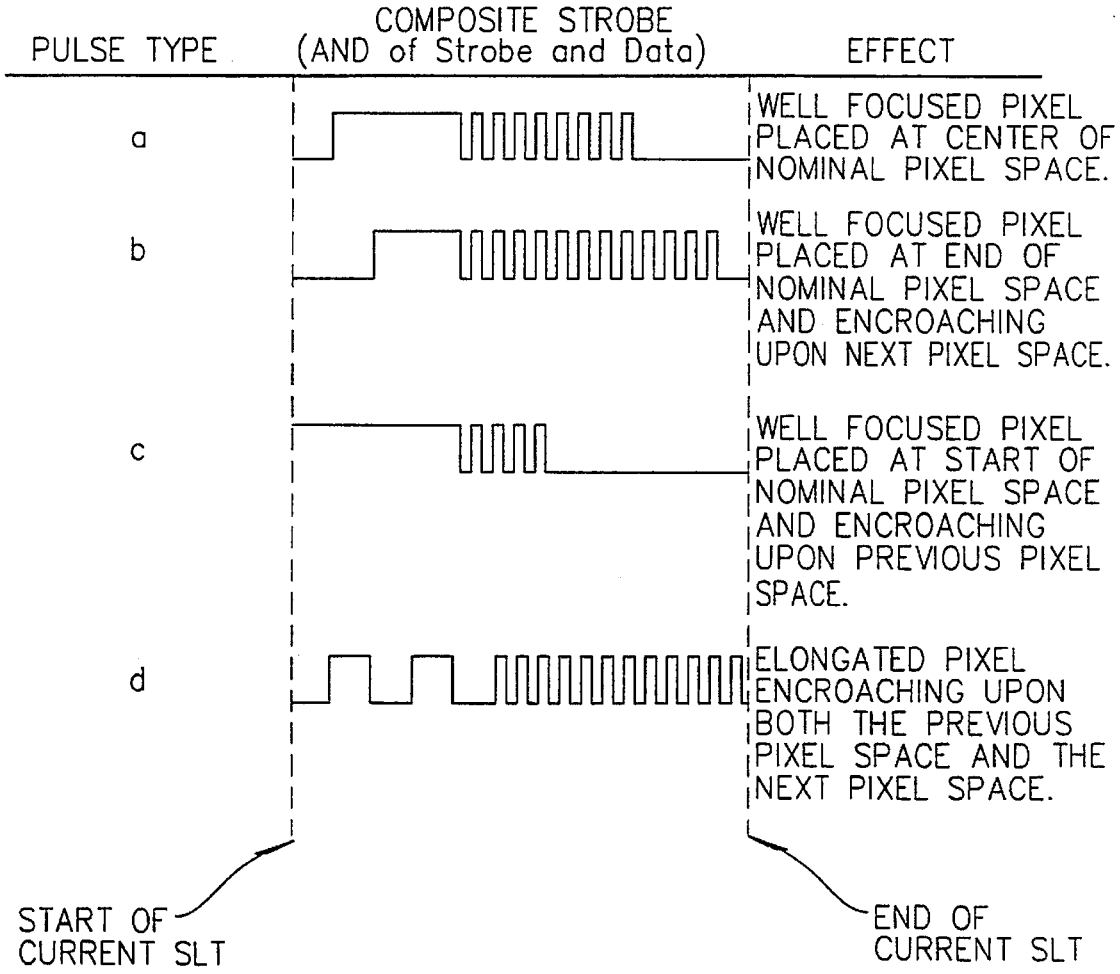
FIG. 11 is a schematic diagram of a pixel displacement aspect of the present invention.

FIG. 11 is a schematic diagram of a pixel displacement aspect of the present invention. Controlled pixel displacement is desirable when the user wishes to adjust the position of the pixel within the region of the print medium scanned during the SLT. For example, the placement of the pixel can be made a function of the states of the preceding and next future print elements. If the previous and next print elements are both off, it is satisfactory to place the current pixel in the center of the nominal pixel space. If the previous print element state was off and the next print element state is on, indicating the beginning of a print region, it is desirable to place the pixel at the end of the nominal pixel space by lengthening the modulated portion of the strobe signal. On the other hand, if the previous print element state is on and the next print element state is off, indicating that the printer is reaching the end of a print region, it is desirable to place the pixel at the beginning of the nominal pixel space. This is accomplished by shortening the modulated portion of the strobe and employing the full duration of the power on portion of the strobe. Finally, if the previous print element state is on and the next state is on also, it is desirable to produce an elongated pixel which encroaches upon both the previous pixel space and the next pixel space. This is accomplished by modulating the full on portion of the strobe signal and using the entire modulated portion of the strobe signal.

Reduced thermal stress of the print elements (i.e., reducing the peak print element temperature) can be accomplished by modulating the data during the heat-up portion of the strobe but keeping the overall energy dissipation constant by heating for a greater portion of each SLT. This can be accomplished by transferring appropriate reduced thermal stress tables into the historical RAM 242 and employing these tables during periods when high thermal stress can be expected, such as while printing drag print element bar code. In the case where the substrate of the printhead 80 is below optimal printing temperature as sensed by a thermistor (not shown), and based on print element history, neighboring print element activity and/or future print element activity, short energy pulses of a value insufficient to cause darkening of the print medium but sufficient to cause a warming effect in the thermal printer printhead 80 are applied. In a preferred embodiment, this method employs enabling data during short segments of the SLT corresponding to the chopped portion of the printhead strobe. This approach keeps the pulse energy sufficiently below that which would cause printing on the medium and allows the energy of the heat-up portion of the strobe to be varied by changing the length of time the energization signal is applied to the printhead 80, or by varying the chopped duty cycle based on ambient and/or printhead temperature. Furthermore, cold start pulse activity can be linked to indicators of impending print activity, such as paper motion, data communications activity or internal clocks or timing events.

In some applications, it is possible to provide particularly crisp printing by recognizing that the printhead 80 is passing through an area having certain predetermined patterns, such as a large, dark rectangle, or a dark corner. In this case, a review of the current state of the last pixel and the future state of the next pixel (or farther into the future, if desired), will indicate the existence of a pattern representing such a situation. In this case, the data transmitted to the current print element during its SLT can be tailored to provide the desired crispness.

As indicated above, detailed illustrative embodiments are disclosed herein. However, other embodiments, which may be detailed rather differently from the disclosed embodiments, are possible. Consequently, the specific structural and functional details disclosed herein are merely representative: yet in that regard, they are deemed to afford the best embodiments for the purposes of disclosure and to provide a basis for the claims herein, which define the scope of the present invention.

We claim:

1. A method for producing a desired response of a selected first thermal print element within a present interval of time in accordance with a sequence of print commands for the first print element, the sequence of print commands including a present print command designating the printing or non-printing of a pixel during the present interval of time, comprising the steps of:

(a) establishing the present print command in a sequence of print commands for the first print element;

(b) establishing at least one future print command in the sequence of print commands for the first print element;

(c) specifying a data signal for the first print element for the present interval of time as a function of the present and the at least one future print commands for the first print element, the data signal representing energization of the print element during a selected number and order of a plurality of segments of the present interval of time;

(d) generating a strobe signal having a plurality of pulses within the present interval of time, the strobe having a variable number or duration of pulses within the present interval of time;

(e) generating an energization signal for the first print element as a combination of the data signal and the strobe signal to produce the desired response of the first print element during the present interval of time; and (f) applying the energization signal to the first print element.

2. The method of claim 1, further comprising the step of establishing at least one past print command in the sequence of print commands for the first print element and wherein step (c) further includes specifying the first data signal as a function of the past print command for the first print element.

3. The method of claim 1, further comprising the steps of establishing at least one print command in a sequence of print commands for a selected second thermal print element and wherein step (c) further includes specifying the data signal as a function of the print command for the second print element.

4. The method of claim 2, further comprising the steps of establishing at least one print command in a sequence of print commands for a selected third thermal print element located adjacent to the first print element and wherein step (c) further includes specifying the data signal as a function of the print command in the sequence of print commands for the adjacent third print element.

5. A method for producing a desired response of a selected first thermal print element within a present interval of time in accordance with a sequence of print commands for the first print element, the sequence of print commands including a present print command designating the printing or non-printing of a pixel during the present interval of time, comprising the steps of:

(a) establishing a present print command in the sequence of print commands for the first print element;

(b) establishing at least one other print command in the sequence of print commands for the first print element;

(c) establishing at least one print command in a sequence of print commands for a selected second thermal print element located adjacent to the first print element;

(d) specifying a data signal for the first print element for the present interval of time as a function of the present and the at least one other print commands in the sequence of print commands for the first print element and of the at least one print command in the sequence of print commands for the adjacent second print element;

(e) generating a strobe signal having a plurality of pulses within the present interval of time, the strobe signal having a variable number or duration of pulses within the present interval of time;

(f) generating an energization signal for the first print element as a combination of the data signal and the strobe signal to produce the desired response of the first print element during the present interval of time; and (g) applying the energization signal to the first print element.

6. A method for producing an energization signal to energize a selected first thermal print element within a present interval of time to produce a desired response of the first print element in accordance with a sequence of print commands for the first print element, the sequence of print commands including a present print command designating the printing or non-printing of a pixel during the present interval of time, comprising the steps of:

(a) establishing a present print command in the sequence of print commands for the first print element;

(b) establishing at least one other print command in the sequence of print commands for the first print element;

(c) retrieving from a memory one of a plurality of data streams, each data stream representing a data signal corresponding to energization of the print element at selected segments of the present interval of time, each of the plurality of data streams being stored in a location corresponding to a unique combination of the present and at least one other print command;

(d) producing the data signal in response to the retrieved data stream;

(e) generating a strobe signal having a plurality of pulses within the present interval of time, the strobe signal having a variable number or duration of pulses within the present interval of time; and (f) producing the energization signal as a combination of the data signal and the strobe signal.

7. A method for producing an energization signal to energize a selected first thermal print element in an array of thermal print elements within a present interval of time to produce a desired response of the first print element in accordance with a sequence of print commands for the first print element, the sequence of print commands including a present print command designating the printing or non-printing of a pixel during the present interval of time, the desired response including printing of a pixel on a medium that moves relative to the first print element, comprising the steps of:

(a) establishing the present print command in the sequence of print commands for the first print element;

(b) establishing at least one other print command in the sequence of print commands for the first print element;

(c) selecting a desired pattern of the present and the at least one future print commands for the first print element and of the at least one print command for the adjacent second print element;

(d) recognizing the selected pattern upon its occurrence;

(e) upon recognition of the selected pattern, specifying a data stream having a plurality of energization data, each energization datum corresponding to a segment of the present interval of time for the first print element as a function of the present and other print commands for the first print element and of the recognized selected pattern such that the position of a pixel printed by the first print element during the present interval of time is selectively shifted along the direction of movement of the medium; and (f) producing the energization signal as a combination of the data stream and a strobe signal.

8. The method of claim 7, wherein the other print command is a future print command further comprising the step of establishing at least one past print command in the sequence of print commands for the first print element and wherein step (e) further includes specifying the data signal as a function of the at least one past print command for the first print element.

9. The method of claim 8 wherein step (b) includes establishing at least one future print command in the sequence of print commands for the adjacent second print element and wherein the desired pattern selected in step (c) includes a desired pattern of the at least one future print command for the adjacent second print element.

10. The method of claim 7, further comprising the step of establishing at least one print command in a sequence of print commands for an adjacent second print element and wherein the desired pattern selected in step (c) includes a desired pattern of the at least one past print command for the adjacent second print element.

11. The method of claim 7 wherein the array of print elements is used to print codes on the medium, the codes comprising a plurality of picket fence bars, wherein the step of recognizing the selected pattern comprises recognizing a trailing edge portion of a picket fence bar and the step of specifying the data stream such that the position of the pixel is shifted along the direction of movement of the medium comprises specifying the data stream according to an energization schedule to shift the pixel toward the center of the bar.

12. A method for producing an energization signal to energize a selected first thermal print element in an array of thermal print elements of a printer within a present interval of time to produce a desired response of the first print element in accordance with a sequence of print commands for the first print element, the sequence of print commands including a print command designating the printing or nonprinting of a pixel during the present interval of time, the present interval of time comprising a plurality of segments, the printer specifying one or more printer operational parameters including at least one of print speed and printhead temperature, comprising the steps of:

(a) receiving the one or more printer parameters;

(b) establishing the present print command in the sequence of print commands for the first print element;

(c) establishing at least one other command in the sequence of print commands for the first print element;

(d) producing a data signal for each possible combination of the established print commands in response to the received one or more printer parameters and the present and the at least one future print commands for the first print element by specifying a state of the data signal during each of the segments;

(e) producing a strobe signal having a strobe pattern determined in response to the received one or more parameters, the strobe pattern defining the number and duration of the pulses in the present interval of time such that the strobe has a plurality of strobe pulses in the present interval of time; and (f) producing the energization signal as a function of the data signal and the strobe signal.

13. The method of claim 12, further comprising the step of establishing in addition to the present print command and other print command, a third print command in the sequence of print commands for the first print element.

14. The method of claim 13 each data signal corresponds to a unique pattern of the three print commands for the first print element for each combination of specified print parameters.

15. The method of claim 12, further comprising the step of establishing at least one print command in a sequence of print commands for a selected second thermal print element in the array located adjacent to the first print element and wherein step (d) further includes specifying the data signal as a function of the at least one print command for the adjacent second print element.

16. The method of claim 15 wherein each data signal corresponds to a unique pattern of the present and the at least one other print commands for the first print element and the at least one print command for the adjacent second print element for each combination of specified print parameters.

17. A method for producing a desired response of a selected first print element within a present interval of time in accordance with a sequence of print commands for the first print element, the sequence of print commands including a print command designating the printing or non-printing of a pixel during the present interval of time, the desired response including printing of a pixel on a medium that moves relative to the first print element, comprising the steps of:

(a) establishing a plurality of alternative energization signals for the first print element;

(b) storing a data signal corresponding to each of the plurality of established energization signals in a memory;

(c) establishing a present print command in the sequence of print commands for the first print element;

(d) establishing at least one other command in the sequence of print commands for the first print element;

(e) selecting one of the alternative energization signals from the plurality of energization signals to apply to the first print element for the present interval of time as a function of the present, the at least one future and the at least one past print commands for the first print element and of the at least one print command for the adjacent second print element by retrieving one of the data signals corresponding to said selected one of the alternative energization signals, said selected one of the alternative energization signals corresponding to a pixel printed by the first print element during the present interval of time being selectively shifted along the direction of movement of the medium; and (f) applying the selected energization signal to the first print element to energize the first print element and produce the desired response of printing the pixel during the present interval of time shifted along the direction of movement of the medium, whereby the pixel printed can be selectively displaced toward a pixel printed during the immediately prior or future interval of time.

18. A method for producing a desired response of a selected first thermal print element in an array of thermal print elements in a printer within a present interval of time in accordance with a sequence of print commands for the first print element, the sequence of print commands including a print command designating the printing or non-printing of a pixel during the present interval of time, comprising the steps of:

(a) specifying one or more operational parameters of the printer;

(b) establishing the present print command in the sequence of print commands for the first print element;

(c) establishing at least one other print command in the sequence of print commands for the first print element;

(d) specifying a data signal for the first print element and a strobe signal each for the present interval of time, the data signal being a function of the present and the at least one other print commands for the first print element and the strobe having a plurality of pulses and having at least one of a variable pulse width and a variable number of pulses during the present interval of time being dependent upon the specified parameters;

(e) generating an energization signal for the first print element corresponding to the data signal and the strobe signal to produce the desired response of the first print element during the present interval of time; and (f) applying the energization signal to the first print element.

19. The method of claim 18 wherein the step of generating the energization signal includes summing of the data signal and the strobe signal by a logical AND function.

20. The method of claim 18, wherein the other print command is a future print command, further comprising the step of establishing at least one past print command in the sequence of print commands for the print element and wherein step (d) further includes specifying the data signal as a function of the at least one past print command in the sequence of print commands for the first print element.

21. The method of claim 18 wherein step (d) further includes specifying the strobe signal as a function of the received one or more printer parameters.

22. The method of claim 18, further comprising the step of establishing at least one print command in a sequence of print commands for a selected second thermal print element in the array of print elements located adjacent to the first print element and wherein step (d) further includes specifying the data signal as a function of the at least one print command for the adjacent second print element.

23. Apparatus for producing a desired response of a thermal print element within a present interval of time in accordance with a sequence of print commands for the print element, comprising:

(a) an integrated printer controller, the printer controller establishing at least one past print command and at least one future print command in the sequence of print commands for the print element;

(b) a memory storing a plurality of data streams, each data stream including at least three bits, wherein the controller is connected to retrieve a selected one of the data streams in response to the established past and future print commands for the print element;

(c) a strobe generator producing a strobe signal having a plurality of pulses within the present interval of time, the strobe generator being variable to adjust the number of pulses or duration of pulses within the present interval of time; and (d) a signal generator connected to receive the retrieved data stream and to generate an energization signal for the print element in response to the retrieved data signal and the strobe signal to produce the desired response of the print element during the present interval of time; and (e) means for applying the energization signal to the print element, the signal generator further being coupled to the print element to provide the energization signal to the print element.

24. Apparatus for producing an energization signal to energize a selected first thermal print element within a present interval of time to produce a desired response of the first print element in accordance with a sequence of print commands for the first print element, comprising:

(a) a microprocessor producing a present print command and a future print command in the sequence of print commands for the first print element;

(b) a memory having a plurality of locations, each location containing a separate data stream for each respective possible combination of print commands establishable by the microprocessor; and (c) a printhead driver coupled to retrieve a selected one of the data signals corresponding uniquely to the present and the at least one future print commands for the first print element, the printhead driver producing the energization signal as a function of the retrieved selected data signal such that the present print element is energized to selectively shift a printed pixel along a direction of printing.

25. Apparatus for producing an energization signal to energize a selected first thermal print element in an array of thermal print elements within a present interval of time to produce a desired response of the first print element in accordance with a sequence of print commands for the first print element, the desired response including printing of a pixel on a medium that moves relative to the first print element comprising:

(a) printhead controller producing a present print command and a second print command in the sequence of print commands for the first print element and producing a print command for a second print element;

(b) a memory having a memory address corresponding to a selected pattern of the present and second print commands of the first print element and the print command of the second print element, the memory address identifying a location containing a selected data signal corresponding to shifting of a pixel along the direction of movement of the medium; and (c) a printhead driver connected to retrieve the selected data signal in response to the selected pattern, the printhead driver producing the energization signal in response to the data signal such that the position of a pixel printed by the print element during the present interval of time is selectively shifted along the direction of movement of the medium.

26. Apparatus for producing a desired response of a selected first thermal print element in an array of thermal print elements of a printer within a present interval of time in accordance with a sequence of print commands for the first print element, the printer specifying one or more printer operational parameters, comprising:

(a) a microprocessor coupled to receive the one or more printer parameters for the present interval of time, the microprocessor establishing the present print command and a second print command in the sequence of print commands for the first print element;

(b) a memory containing a data signal for the present interval of time, the data signal being a function of the received one or more printer parameters and the present and the at least one future print commands for the first print element;

(c) a strobe generator coupled to receive selected ones of the printer operational parameters, the strobe generator producing a strobe signal corresponding to the received printer operational parameters such that the strobe signal includes a plurality of pulses during the present interval of time, wherein the strobe generator establishes a number of pulses in the present interval of time in response to the received operational parameters; and (d) a printhead driver coupled to receive the strobe signal and the data signal, the printhead driver producing an energization signal for the first print element in response to the data signal and the strobe signal, the printhead driver being coupled to supply the energization signal to the first print element.

27. The apparatus of claim 26 wherein the printhead driver comprises an AND gate.

28. The apparatus of claim 26 wherein the strobe generator is responsive to one or more of the printer parameters of paper sensitivity, print speed, printhead temperature, ambient temperature, power supply voltage, printhead resistance, and darkness control.

29. A method for producing an energization signal for a print element during a scan line time of a printhead, the scan line time including a plurality of segments, comprising the steps of:

determining a schedule of printing activity for the print element during the present scan line time and an additional scan line time;

producing an energization schedule in response to the determined schedule of printing activity, the energization schedule indicating the energization or non-energization of the print element during each of the segment;

producing a data signal corresponding to the energization schedule;

determining a printing parameter;

determining a strobe pattern in response to the determined printing parameter the strobe pattern including a plurality of pulses within the scan line time;

producing a strobe signal, the strobe signal following the strobe pattern during the scan line time; and combining the strobe signal and the data signal to produce the energization signal.

30. The method of claim 29 wherein the step of determining a strobe pattern corresponding to the determined printing parameter includes determining a high or low state of the strobe signal during a plurality of intervals within the scan line time.

31. The method of claim 30 wherein the step of determining a printing parameter includes monitoring a temperature proximate the printhead, and the step of determining a strobe pattern corresponding to the determined printing parameter includes adjusting one of a duty cycle, the number and position of pulses during the scan line time of the strobe pattern in response to the monitored temperature.

32. The method of claim 29 wherein the step of producing an energization schedule includes selecting a plurality of ON segments in which the print element is energized and a plurality of OFF segments in which the print element is not energized.

33. The method of claim 32 wherein the step of selecting a plurality of ON segments and a plurality of OFF segments includes grouping the ON segments such that the energy in the energization signal is shifted along the scan line time.

34. The method of claim 32 wherein the step of selecting a plurality of ON segments and a plurality of OFF segments includes the steps of:

selecting a desired pixel shape in response to the schedule of printing activity; and selecting the plurality of ON segments corresponding to the desired pixel shape.

35. The method of claim 29 wherein the step of producing an energization schedule includes selecting a plurality of ON segments in which the print element is energized and a plurality of OFF segments in which the print element is not energized.

36. The method of claim 35 wherein the step of selecting a plurality of ON segments and a plurality of OFF segments includes the steps of:

selecting a desired pixel shape in response to the schedule of printing activity; and selecting the plurality of ON segments corresponding to the desired pixel shape.

37. A thermal printer for printing an image on a thermally sensitive medium in response to an image signal, comprising:

a thermal printhead having a plurality of print elements;

an integrated printhead controller, the printhead controller receiving the image signal and establishing a printing schedule for a selected one of the print elements in response to the received image signal, the printing schedule specifying the printing or nonprinting of a pixel during selected scan line times;

a memory containing a plurality of data streams, each data stream including a plurality of bits, each bit representing the energization or non-energization of the print element during a segment of a scan line time;

a monitor connected to detect one or more printing parameters;

a strobe generator connected to receive the detected printing parameters and to produce a strobe signal corresponding to the received printing parameters, the strobe generator being operative to produce a plurality of strobe pulses during each scan line time; and a driver circuit connected to receive the printing schedule and to retrieve one of the data streams in response thereto, the driver circuit further being connected to receive the strobe signal, the driver circuit being connected to supply an energization signal to the selected print element in response to the strobe signal and the retrieved data stream.

38. The thermal printer of claim 37 wherein the driver circuit includes an AND gate connected to produce the energization as the logical AND of the data signal and the strobe signal.

39. A method for producing an energization signal for a print element during a scan line time of a printhead to print a pixel of an image, the scan line time including a plurality of segments, comprising the steps of:

determining a schedule of printing activity for the print element during the present scan line time and an additional scan line time;

determining a pixel shifting direction in response to the determined schedule of printing activity;

producing an energization schedule in response to the determined schedule of printing activity and the determined pixel shifting direction, the energization schedule indicating the energization or non-energization of the print element during each of the segments, the energization schedule corresponding to shifting of the pixel in the pixel shifting direction;

producing a data signal corresponding to the energization schedule; and producing the energization signal in response to the data signal.

40. A method for producing an energization signal for a print element during a scan line time of a printhead to print a pixel having a desired pixel shape different from a nominal pixel shape, the scan line time including a plurality of segments, comprising the steps of:

determining a schedule of printing activity for the print element during the present scan line time and an additional scan line time;

selecting the desired pixel shape in response to the determined schedule of printing activity;

producing an energization schedule in response to the determined schedule of printing activity and the selected desired pixel shape, the energization schedule indicating the energization or non-energization of the print element during each of the segments;

producing a data signal corresponding to the energization schedule; and producing the energization signal in response to the data signal.

41. The method of claim 40 wherein the step of producing an energization schedule includes selecting a plurality of ON segments in which the print element is energized and a plurality of OFF segments in which the print element is not energized.

42. The method of claim 41 wherein the step of selecting a plurality of ON segments and a plurality of OFF segments includes grouping the ON segments such that the energy in the energization signal is shifted along the scan line time.

43. The method of claim 41 wherein the step of selecting a plurality of ON segments and a plurality of OFF segments includes the steps of selecting the plurality of ON segments corresponding to the desired pixel shape.

44. The method of claim 40 wherein the desired pixel shape is an elongated shape.

* * * * *

UNITED STATES PATENT AND TRADEMARK OFFICE

CERTIFICATE OF CORRECTION

PATENT NO. : 5,625,399
DATED : April 29, 1997
INVENTOR(S) : Christopher A. Wiklof et al.

It is certified that error appears in the above-identified patent and that said Letters Patent is hereby corrected as shown below:

In column 12, claim 1, line 6, preceding "having" please insert --signal--.

In column 15, claim 18, line 64, immediately following "element" please insert --,--.

In column 18, claim 29, line 17, please delete "segment" and insert therefor --segments--.

In column 18, claim 29, line 23, immediately following "parameter" please insert --,--.

Signed and Sealed this

Thirteenth Day of January, 1998

Bruce Lehman

*Attest:*

BRUCE LEHMAN

*Attesting Officer*

*Commissioner of Patents and Trademarks*